US005590204A

United States Patent [19]

Lee

[11] Patent Number: 5,590,204

[45] Date of Patent: Dec. 31, 1996

[54] DEVICE FOR REPRODUCING 2-CHANNEL SOUND FIELD AND METHOD THEREFOR

[75] Inventor: Hee-Soo Lee, Suwon, Rep. of Korea

[73] Assignee: Samsung Electronics Co., Ltd., Kyungki-do, Rep. of Korea

[21] Appl. No.: 987,449

[22] Filed: Dec. 7, 1992

[30] Foreign Application Priority Data

Dec. 7, 1991 [KR] Rep. of Korea ..... 1991-22376

[51] Int. Cl.[6] ..... H04R 5/00

[52] U.S. Cl. ..... 381/24; 381/23; 381/25

[58] Field of Search ..... 381/18, 25, 1, 381/17, 24, 22, 23

[56] References Cited

U.S. PATENT DOCUMENTS

| | | | |
|---|---|---|---|
| 4,097,689 | 6/1978 | Yamada et al. | 381/25 |
| 4,121,059 | 10/1978 | Nakabayashi . | |
| 4,347,405 | 8/1982 | Davis | 381/25 |
| 4,642,812 | 2/1987 | Yoshio et al. . | |
| 4,812,921 | 3/1989 | Mitsuhashi et al. . | |
| 4,866,774 | 9/1989 | Klayman | 381/1 |
| 4,868,878 | 10/1989 | Kunugi et al. . | |
| 4,908,858 | 3/1990 | Ohno | 381/18 |
| 4,910,779 | 3/1990 | Cooper et al. | 381/1 |
| 5,023,913 | 6/1991 | Matsumoto et al. | 381/1 |
| 5,065,432 | 11/1991 | Sasaki et al. | 381/61 |
| 5,305,386 | 10/1991 | Yamato | 381/17 |

*Primary Examiner*—Curtis Kuntz
*Assistant Examiner*—Ping W. Lee
*Attorney, Agent, or Firm*—Sughrue, Mion, Zinn, Macpeak & Seas

[57] ABSTRACT

A method of reproducing a sound field using digital signal processors in which 2-channel stereo signals are received and converted into 4-channel sound field signals through a first DSP and the 4-channel sound field signals are adaptively composed corresponding to a headphone mode or a speaker mode, again to be into 2-channel sound field signals through a second DSP thereby reproducing 4-channel sound field feeling by 2 channels.

6 Claims, 4 Drawing Sheets

DEVICE FOR REPRODUCING 2-CHANNEL SOUND FIELD AND METHOD THEREFOR

BACKGROUND OF THE INVENTION

The present invention relates to a sound field reproducing system, and more particularly to a device and method for reproducing 2-channel audio signals into a sound field so that the audio signals are identical to those in an actual performance.

Generally, a sound field reproducing system should reproduce the presence of audio sound like that of the actual performance state. To reproduce the audio sound to have such presence, the characteristic of a human's ear should be known. The human's ear can sense the sound arriving direction. Thus, the transfer characteristics Hr(x) and Hl(x) exist at a route where the audio sound X(t) is received at the ear from the speakers of the sound reproducing system. That is, the transfer characteristics determine whether the audio sound currently audible in the human's ear is from the front or the rear. Accordingly, to make the sound reproduced actually in the front be like that from the audience's rear, the sound field should be reproduced by an extra transfer characteristic process before the sound from speaker is outputted. The sound field reproducing method for processing the transfer characteristic uses a DSP (Digital Signal Processor) to give to an arbitrary sound source an initial reflected sound and reverberation as being played in actual audible space or virtual audible space.

However, to reproduce the sound field by using the above-mentioned method, only when the speaker should be arranged in the sound listening direction, the sound from the direction can be reproduced. Moreover, when a virtual sound field is reproduced with a headphone, it is very difficult to reproduce an actual sound field because direction information is not included in the sound field. Thus, even if a virtual sound field reproducing device exists, if an actual reproducing space where a plurality of speakers can be arranged is not obtained, there is a problem in that the desired sound field cannot be reproduced.

SUMMARY OF THE INVENTION

Accordingly, it is an object of the present invention to provide a device and method for reproducing a sound field like an actual performance in a space where a plurality of speakers cannot be arranged.

It is another object of the present invention to provide a device and method for reproducing a desired sound field by using a speaker or headphone.

To achieve these objects, the present invention utilizes two DSPs, one of which receives 2-channel stereo signals, as in a conventional system, and divides the signals into 4-channel signals, and at the same time, gives to the divided signals sound field signals, respectively. The other DSP again composes the 4-channel signals, which are reproduced by the two-channel reproducing circuit for a speaker mode or a headphone mode, thereby reproducing a sound field feeling.

A digital sound field reproducing device includes an analog-digital converter for converting 2-channel analog stereo signals into 2-channel digital stereo signals, and a first digital signal processor for converting the 2-channel digital stereo signals into 4-channel sound field signals. An auxiliary memory expands a memory region of the first digital signal processor under the control of the first digital signal processor, and a second digital signal processor composes the 4-channel sound field signals to generate 2-channel sound field signals. A microcomputer controls the sound field reproduction processes of the first digital signal processor and the second digital signal processor, according to a program stored in the microcomputer, and a keyboard with a plurality of function keys generates a key signal, in response to a speaker mode or a headphone mode to the microcomputer. A display circuit displays a plurality of operation states including a speaker mode or a headphone mode under the control of the microcomputer, and a digital-analog converter converts the 2-channel sound field signals generated from the second digital signal processor into analog signals. A switching circuit selectively generates the analog signals generated from the digital-analog converter to a headphone or speakers under the control of the microcomputer.

BRIEF DESCRIPTION OF THE DRAWINGS

For a better understanding of the invention, reference will now be made, by way of example only, to the accompanying drawings, in which.

DETAILED DESCRIPTION OF THE PREFERRED EMBODIMENTS

Figure 1:
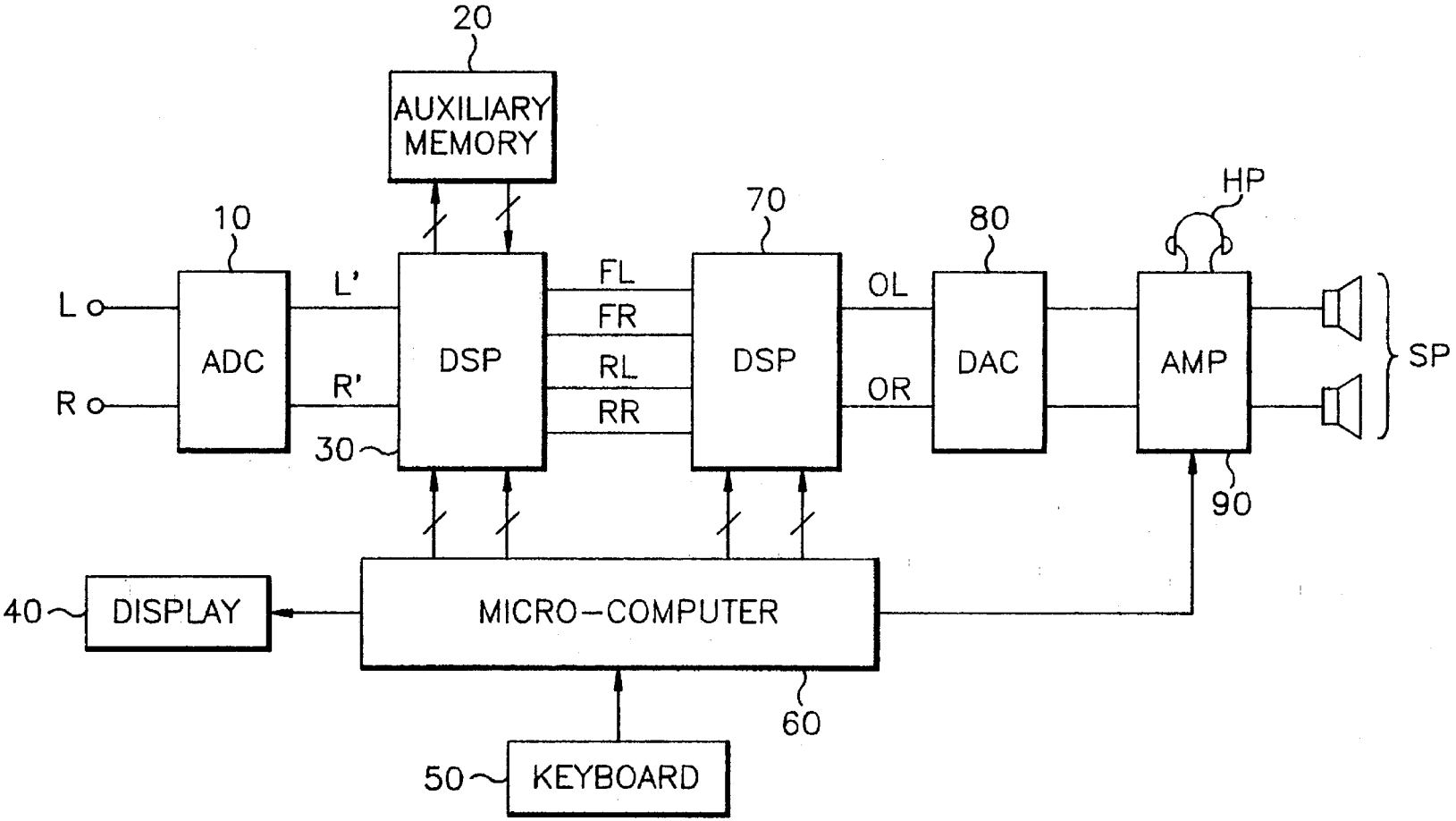
FIG. 1 is a sound field reproducing system diagram according to the present invention.

Referring to FIG. 1, an ADC (Analog Digital Converter) 10 receives 2-channel analog stereo signals to be converted into the respective digital signals, and a first DSP 30 converts 2-channel digital stereo signals into 4-channel sound field signals. An auxiliary memory 20 expands a memory region of the first DSP 30 under the control of the first DSP 30, and a second DSP 70 receives and composes the 4-channel sound field signals generated in the first DSP 30 to generate 2-channel sound field signals which can reproduce the same sound field as that in 4 channels. A microcomputer 60 controls, according to a predetermined program stored therein, the first DSP 30 and the second DSP 70 to reproduce a sound field, and a keyboard 50 includes a plurality of function keys for generating a key signal corresponding to a speaker mode or a headphone mode to the microcomputer 60. A display circuit 40 displays a plurality of operation states including a speaker mode or a headphone mode under the control of the microcomputer 60, a DAC (Digital Analog Converter) 80 converts a 2-channel sound field signal from the second DSP 70 into an analog signal, and a switching circuit 90 selectively generates the output signal of the DAC 80 to a headphone HP or speaker SP under the control of the microcomputer 60.

Figure 2:
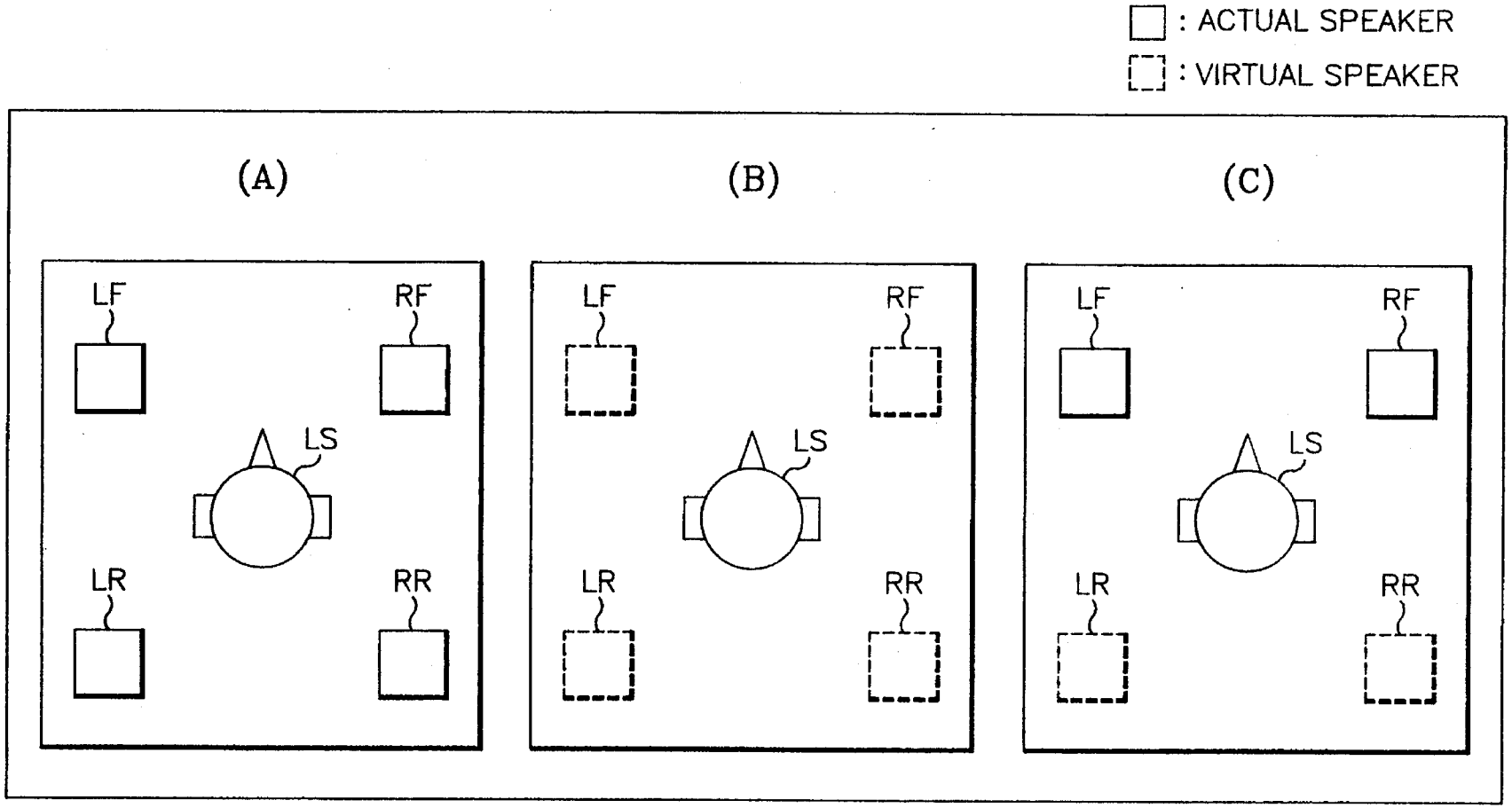
FIGS. 2A to 2C show the constitutions of speakers according to the respective modes of the present invention.

FIG. 2A shows a constitution of actual speakers installed in audio an reproducing space, FIG. 2B shows a constitution of virtual speakers in a headphone mode, and FIG. 2C shows a constitution of actual speakers and virtual speakers in a speaker mode.

Figure 3:
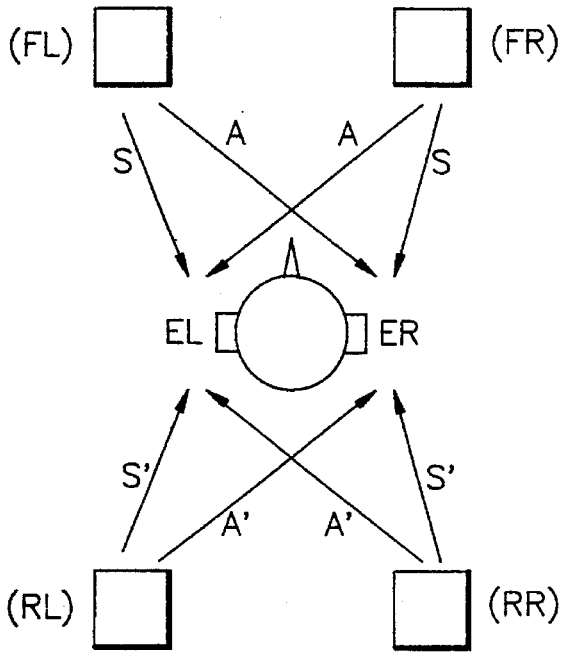
FIG. 3 shows a signal flow according to a headphone mode of the present invention.
Figure 4:
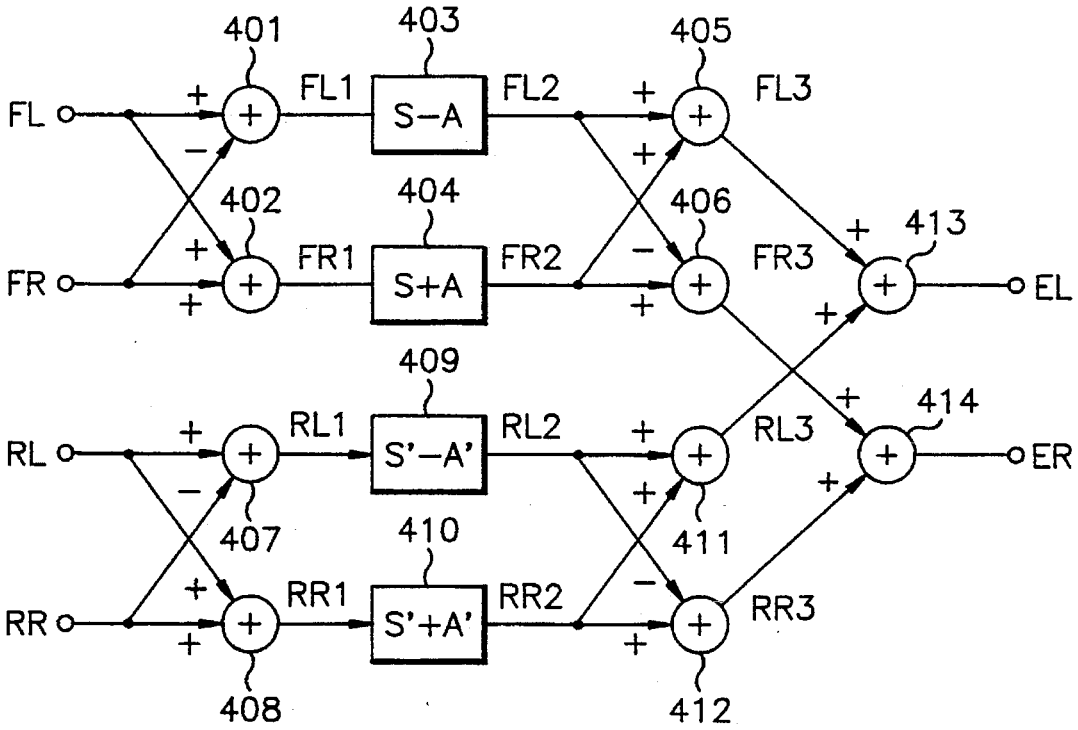
FIG. 4 shows an algorithm of a headphone mode according to the present invention.

FIG. 3 shows a signal flow according to a headphone mode of the present invention, and FIG. 4 shows an algorithm according to a headphone mode of the present invention. 4-channel sound field signals are a front left signal (hereinafter referred to as FL), a front right signal (hereinafter referred to as FR), a rear left signal (hereinafter referred to as RL) and a rear right signal (hereinafter referred to as RR). The signal FL is added to the signal FR in adder 402 to generate a signal FR1, the signal FR is subtracted from the signal FL in subtracter 401 to generate a signal FL1, the signal RL is added to the signal RR in adder 408 to generate a signal RR1, and the signal RR is subtracted from the signal RL in subtracter 407 to generate a signal RL1. The signals FL1, FR1, RL1, and RR1 are converted into signals FL2, FR2, RL2 and RR2, respectively by giving different transfer characteristics filters 403–404 and 409–410 to the respective signals. The signal FL2 is added to the signal FR2 in adder 405 to generate an FL3 signal, and the signal FL2 is subtracted from the signal FR2 in subtracter 406 to generate a signal FR3. The signal RL2 is added to the signal RR2 in adder 411 to generate a signal RL3, and the signal RL2 is subtracted from the signal RR2 in substrate 412 to generate a signal RR3. The signal FL3 is added to the signal RL3 in adder 413 to generate one-channel signal EL, and the signal FR3 is added to the signal RR3 in adder 414 to generate the other-channel signal ER, thereby finally generating 2-channel sound field signals.

The method of giving transfer characteristics to the FL1, FR1, RL1, and RR1 signals is described as follows. When the transfer characteristic of a signal provided at the audience's left ear from a front left speaker and a signal provided at the audience's right ear from a front right speaker is represented by S, the transfer characteristic of a signal provided at the audience's left ear from a rear left speaker and a signal provided at the audience's right ear from a rear right speaker is represented by S', the transfer characteristic of a signal provided at the audience's right ear from the front left speaker and a signal provided at the audience's left ear from the front right speaker is represented by A, and the transfer characteristic of a signal provided at the audience's right ear from the rear left speaker and a signal provided at the audience's left ear from the rear right speaker is represented by A', the signal FL1 is filtered by filter 403 into the signal FL2 by a filter having a transfer characteristic S–A. The signals FR2, RL2, and RR2 are filtered by filters 404, 409 and 410 respectively, by the same method as the signal FL2, with the only difference being that the transfer characteristics are S+A, S'–A', and S'+A', respectively.

Figure 6:
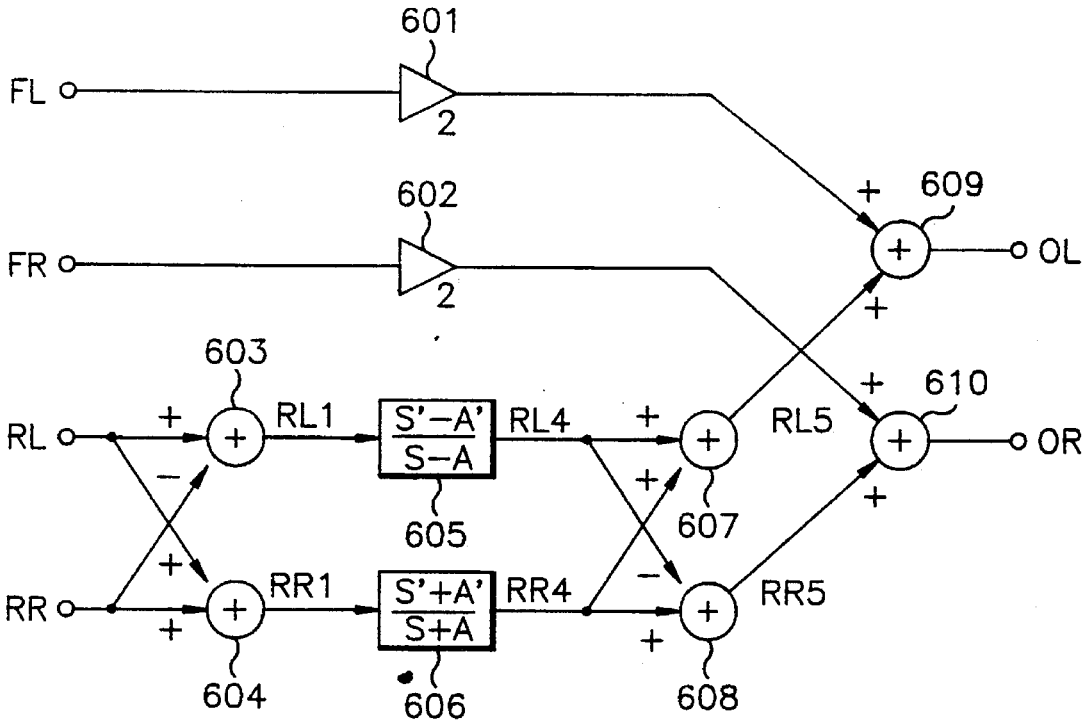
FIG. 6 shows an algorithm of a speaker mode according to the present invention.

FIG. 6 is an algorithm according to a speaker mode of the present invention. The signal RR is subtracted from the signal RL in substrate 603 to generate the signal RL1, and the signal RL is added to the signal RR in adder 604 to generate the signal RR1. The respective predetermined transfer characteristics are given to the signal RL1 and the signal RR1 by filters 605 and 606 to generate a signal RL4 and a signal RR4, and a signal RL5 is generated by adding the signal RL4 in adder 607 to the signal RR4, and a signal RR5 by subtracting the signal RL4 from the signal RR4 in adder 608. The levels of the signal FL and the signal are properly controlled by amplifiers 601–602, and the level-controlled signals are added to the signal RL5, in adders 609 and 610 and the signal RR5, respectively, thereby generating 2-channel sound field signals OL and OR.

The method of giving transfer characteristics to the signal RL1 and the signal RR1 and generating the signals RL4 and RR4 is the same as that for embodying the RL2 and RR2 signals as shown in FIG. 6, with the only difference being that the frequency characteristics of the filters 605 and 606 are changed to (S'–A')/(S–A) and (S'+A')/(S+A), respectively.

Figure 5:
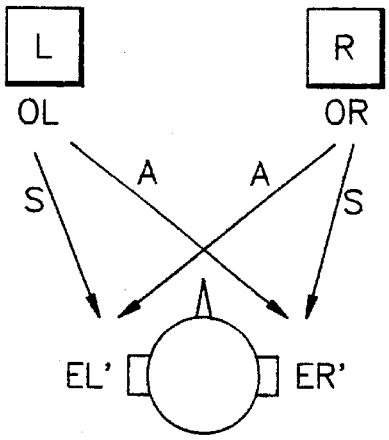
FIG. 5 shows a signal flow according to a speaker mode of the present invention.

FIG. 5 shows a signal flow according to a speaker mode of the present invention, which represents a path for output signals OL and OR in a speaker mode to be actually provided at an audience's ear through speakers. Here, the transfer characteristic of a signal provided at the audience's left ear from the front right speaker and a signal provided at the audience's right ear from the front left speaker is represented by A and the transfer characteristic of a signal provided at the audience's right ear from the front right speaker and a signal provided at the audience's left ear from the front left speaker is represented by S.

It is necessary to provide a transfer characteristic including a direction information to a sound signal, thereby making the sound reach both of the ears as a stereo sound. In order for the artificially calculated virtual sound field to be heard in all directions at the audience's position, it is more effective to independently process each direction. However, in the case of actually constituting a system, it makes the system complex to embody the virtual sound field signals of all directions.

Thus, in the present invention, a concept of virtual speakers is introduced to obtain the same effect with a more simplified constitution, instead of independently processing the respective sound fields. This means the actually non-existing virtual speakers, when the sound field reproduced by the conventional four speakers is reproduced by a headphone or two speakers.

In case of "headphone mode" of FIG. 2B, even if speakers really do not exist, in the sound processing step, the acoustic effect as if four speakers exist on four sides, can be obtained, and the setting of the directions with respect to the respective virtual speakers is controlled by sound volume of four virtual speakers. Also, in case of "a speaker mode" of FIG. 2C, actual speakers are installed in the front of the audience, and virtual speakers generated by a signal processing are performed in the rear part instead of installing actual speakers.

In the present invention, after 2-channel stereo signals, R and L signals, are received and then 4-channel sound field signals FL, FR, RL, and RR are generated, the 4-channel sound field signals are again processed, thereby obtaining the same sound field reproducing effect in 2 channels as that in the 4 channels. The method of receiving the 2-channel stereo signals and generating 4-channel sound field signals is described in detail in Korean Patent Application No. 91-2402 previously filed by the present applicant.

According to the present invention, the methods of mixing the 4-channel sound field signals into the 2-channel sound field signals are different according to a headphone mode and a speaker mode. This is because during the use of the headphone, a left signal and a right signal do not make any interference, but during the use of speakers, the signals of both speakers interfere with each other. Thus, when the speaker mode is used, an extra algorithm provided for canceling the interference signals between R and L. In case of a headphone mode, it is simulated by a DSP algorithm shown in FIG. 4, for the sound field processed 4-channel signals FR, FL, RR, and RL to be converted into audible sound in the front and rear speakers and then reach the audience's ear. The transfer characteristics provided at both of the audience's ears from each of four speakers are obtained by actually being measured using dummy heads.

As shown in FIG. 3, there are four transfer characteristics outputted in the respective sound source and provided at the audience's ears. In this case, the transfer characteristic arrived at the left ear from a left sound source is assumed to be the same as that arrived at the right ear from the right sound source. Here, S is a direct sound transfer characteristic from the front speaker, A is an indirect sound transfer characteristic from the front speaker, S' is a direct sound transfer characteristic from the rear speaker, and A' is an indirect sound transfer characteristic from the rear speaker. After the four sound sources FR, FL, RR, and RL pass through the space having S, A, S' and A' transfer characteristics, the states in frequency domain become:

$$ER=S\cdot FR+A\cdot FL+S'\cdot RR+A'\cdot RL$$

$$EL=A\cdot FR+S\cdot FL+A'\cdot RR+S'\cdot RL$$

and the above two equations are obtained by the algorithm shown in FIG. 4.

Until now, the process of converting 4-channel input signals into 2 signals has be described. The process of 'S–A' in the algorithm of FIG. 4 can be obtained by FIR-filtering (finite impulse response filtering) the input digital signal.

In case of speaker mode, if the process of the headphone mode is used as it is, the interference between signal R and signal L outputted from the speakers is generated and actually gives a wrong effect at the audience's ear. When the signals EL and ER processed in the headphone mode are outputted through two speakers, the sound reaching the audience is as follows:

$$EL'=S\cdot EL+A\cdot ER$$

$$ER'=A\cdot EL+S\cdot ER$$

and accordingly, the desired characteristics cannot be obtained. Also, in the speaker mode, the same effect as in the headphone mode should be obtained. That is, EL'=EL, and ER'=ER should be obtained. Thus, the algorithm for the headphone mode cannot be used, and an extra algorithm is needed, which is shown in FIG. 6. The 4-channel sound field signals FL, FR, RL and RR are converted into 2-channel signals OL and OR through the second DSP 70. That is, $$OL=2\cdot\frac{SS'-AA'}{S^2-A^2}\cdot RL+2\cdot\frac{SA'-AS'}{S^2-A^2}\cdot RR+2\cdot FL$$

$$OR=2\cdot\frac{SA'-AS'}{S^2-A^2}\cdot RL+2\cdot\frac{SS'-AA'}{S^2-A^2}\cdot RR+2\cdot FR$$

Since the signals OL and OR of the above equations are replaced by signals EL and ER, the characteristics of signals EL' and ER' passed through the space become equal to the characteristics signals EL and ER of the headphone mode.

The hardware constitution of the present invention is similar in the constitution using the DSP to that of Korean Patent Application No.91-2402, and is different in the constitution of connecting in series the sound field generating first DSP 30 to the second DSP 70 for a stereophonic processing by localizing and cross talk removal process.

The DSP algorithm used in the first DSP 30 and the second DSP 70 is driven by the microcomputer 60, on whose memory the corresponding algorithm and coefficient data are stored. The microcomputer 60 recognizes either headphone mode or speaker mode by the keyboard 50, and drives the DSP algorithm corresponding to the respective mode and at the same time, controls the amplifier 90, thereby switching the headphone and speaker line.

Hereinafter, the signals in FIGS. 4 and 6 are analyzed using matrices, which shows that the output signals EL and ER of the headphone are equal to the signals EL' and ER' of a speaker mode.

$$\begin{vmatrix} FL1 \\ FR1 \end{vmatrix}=\begin{vmatrix} 1 & -1 \\ 1 & 1 \end{vmatrix}\begin{vmatrix} FL \\ FR \end{vmatrix} \tag{1}$$

$$\begin{vmatrix} FL2 \\ FR2 \end{vmatrix}=\begin{vmatrix} S-A & 0 \\ 0 & S+A \end{vmatrix}\begin{vmatrix} FL1 \\ FR1 \end{vmatrix}=$$

$$\begin{vmatrix} S-A & 0 \\ 0 & S+A \end{vmatrix}\begin{vmatrix} 1 & -1 \\ 1 & 1 \end{vmatrix}\begin{vmatrix} FL \\ FR \end{vmatrix}=\begin{vmatrix} S-A & -(S-A) \\ S+A & S+A \end{vmatrix}\begin{vmatrix} FL \\ FR \end{vmatrix}$$

$$\begin{vmatrix} FL3 \\ FR3 \end{vmatrix}=\begin{vmatrix} 1 & 1 \\ -1 & 1 \end{vmatrix}\begin{vmatrix} FL2 \\ FR2 \end{vmatrix}=\begin{vmatrix} 2S & 2A \\ 2A & 2S \end{vmatrix}\begin{vmatrix} FL \\ FR \end{vmatrix}$$

Also, $$\begin{vmatrix} RL3 \\ RR3 \end{vmatrix}=\begin{vmatrix} 2S' & 2A' \\ 2A' & 2S' \end{vmatrix}\begin{vmatrix} RL \\ RR \end{vmatrix} \tag{2}$$

From equations (1) and (2)

$$\begin{vmatrix} EL \\ ER \end{vmatrix}=\begin{vmatrix} FL3 \\ FR3 \end{vmatrix}+\begin{vmatrix} RL3 \\ RR3 \end{vmatrix}=2\cdot\begin{vmatrix} S & A \\ A & S \end{vmatrix}\begin{vmatrix} FL \\ FR \end{vmatrix}+2\cdot\begin{vmatrix} S' & A' \\ A' & S' \end{vmatrix}\begin{vmatrix} RL \\ RR \end{vmatrix}$$

Analyzing the algorithm of FIG. 6, $$\begin{vmatrix} RL1 \\ RR1 \end{vmatrix}=\begin{vmatrix} 1 & -1 \\ 1 & 1 \end{vmatrix}\begin{vmatrix} RL \\ RR \end{vmatrix} \tag{3}$$

$$\begin{vmatrix} RL2 \\ RR2 \end{vmatrix}=\begin{vmatrix} \frac{S'-A'}{S-A} & 0 \\ 0 & \frac{S'+A'}{S+A} \end{vmatrix}\begin{vmatrix} RL1 \\ RR1 \end{vmatrix}=$$

$$\begin{vmatrix} \frac{S'-A'}{S-A} & -\frac{S'-A'}{S-A} \\ \frac{S'+A'}{S+A} & \frac{S'+A'}{S+A} \end{vmatrix}\begin{vmatrix} RL \\ RR \end{vmatrix}$$

$$\begin{vmatrix} RL3 \\ RR3 \end{vmatrix}=\begin{vmatrix} 1 & 1 \\ -1 & 1 \end{vmatrix}\begin{vmatrix} RL2 \\ RR2 \end{vmatrix}=2\begin{vmatrix} \frac{SS'-AA'}{S^2-A^2} & \frac{SA'-AS'}{S^2-A^2} \\ \frac{SA'-AS'}{S^2-A^2} & \frac{SS'-AA'}{S^2-A^2} \end{vmatrix}\begin{vmatrix} RL \\ RR \end{vmatrix}$$

$$\text{If}\begin{vmatrix} \frac{SS'-AA'}{S^2-A^2} & \frac{SA'-AS'}{S^2-A^2} \\ \frac{SA'-AS'}{S^2-A^2} & \frac{SS'-AA'}{S^2-A^2} \end{vmatrix}$$

$$\begin{vmatrix} OL \\ OR \end{vmatrix}=\begin{vmatrix} RL3 \\ RR3 \end{vmatrix}+2\begin{vmatrix} 1 & 0 \\ 0 & 1 \end{vmatrix}\begin{vmatrix} FL \\ FR \end{vmatrix}=2\cdot M1\begin{vmatrix} RL \\ RR \end{vmatrix}+2\begin{vmatrix} 1 & 0 \\ 0 & 1 \end{vmatrix}\begin{vmatrix} FL \\ FR \end{vmatrix}$$

Actually, the process by DSPs is processed here, and then signals OL and OR are outputted through the speakers. Since the signal outputted through the speaker reaches the person's ear via the transfer characteristics S and A as shown in FIG. 5, the characteristic equation is as follows.

$$\begin{vmatrix} EL' \\ ER' \end{vmatrix}=\begin{vmatrix} S & A \\ A & S \end{vmatrix}\begin{vmatrix} OL \\ OR \end{vmatrix}$$

$$=2\cdot\begin{vmatrix} S & A \\ A & S \end{vmatrix}\cdot M1\cdot\begin{vmatrix} RL \\ RR \end{vmatrix}+2\cdot\begin{vmatrix} S & A \\ A & S \end{vmatrix}\begin{vmatrix} 1 & 0 \\ 0 & 1 \end{vmatrix}\begin{vmatrix} FL \\ RR \end{vmatrix}$$

$$=2\begin{vmatrix} S' & A' \\ A' & S' \end{vmatrix}\begin{vmatrix} RL \\ RR \end{vmatrix}+2\begin{vmatrix} S & A \\ A & S \end{vmatrix}\begin{vmatrix} FL \\ RR \end{vmatrix}$$

Accordingly, the characteristic in the headphone mode becomes equal to that in the speaker mode.

As described above, the present invention converts 2-channel stereo signals into 4-channel sound field signals, again signal-processes them into 2-channel signals, and gives sound fields corresponding to the headphone mode or speaker mode to the 2-channel sound field signals, thereby solving the disadvantage of the conventional 4-channel sound field reproducing device discussed above.

What is claimed is:

1. A sound field reproducing method for a stereo system including a first digital signal processor generating four sound signals, including a first front left sound field signal, a first front right sound field signal, a first rear left sound field signal and a first rear right sound field signal, from two input sound signals, a second digital signal processor combining the four sound signals received from said first digital signal processor into a first channel signal and a second channel signal provided via a stereo amplifier to a headphone, said method comprising the steps of:

adding said first front left sound field signal to said first front right sound field signal to generate a second front right sound field signal, subtracting said first front right sound field signal from said first front left sound field signal to generate a second front left sound field signal, adding said first rear left sound field signal to a first rear right sound field signal to generate a second rear right sound field signal, and subtracting said first rear right sound field signal from said first rear left sound field signal to generate a second rear left sound field signal;

filtering said second front left sound field signal, said second front right sound field signal, said second rear left sound field signal, and said second rear right sound field signal into a third front left sound field signal, a third front right sound field signal, a third rear left sound field signal and a third rear right sound field signal, respectively, said third front left sound field signal, said third front right sound field signal, said third rear left sound field signal and said third rear right signal having transfer characteristics;

adding said third front left sound field signal to said third front right sound field signal to generate a fourth front left sound field signal, subtracting said third front left sound field signal from said third front right sound field signal to generate a fourth front right sound field signal, adding said third rear left sound field signal to said third rear right sound field signal to generate a fourth rear left sound field signal, and subtracting said third rear left sound field signal from said third rear right sound field signal to generate a fourth rear right sound field signal; and adding said fourth front left sound field signal to said fourth rear left sound field signal to generate said first channel signal, and adding said fourth front right sound field signal to said fourth rear right sound field signal to generate said second channel signal.

2. A sound field reproducing method for a stereo system including a first digital signal processor generating four sound signals, including a first front left sound field signal, a first front right sound field signal, a first rear left sound field signal and a first rear right sound field signal, from two input sound signals, a second digital signal processor combining the four sound signals received from said first digital signal processor into a first channel signal and a second channel signal provided via a stereo amplifier to speakers, said method comprising the steps of:

adding said first rear left sound field signal to said first rear right sound field signal to generate a second rear right sound field signal, and subtracting said first rear left sound field signal from said first rear right sound field signal to generate a second rear left sound field signal;

filtering said second rear left sound field signal and said second rear right sound field signal into a third rear left sound field signal and a third rear right sound field signal, respectively, said third rear left sound field signal and said third rear right sound field signal having transfer characteristics;

adding said third rear left sound field signal to said third rear right sound field signal to generate a fourth rear left sound field signal, and subtracting said third rear left sound field signal from said third rear right sound field signal to generate a fourth rear right sound field signal; and adding a level-controlled said first front left sound field signal to said fourth rear left sound field signal to generate said first channel signal, and adding a level-controlled said first front right sound field signal to said fourth rear right signal to generate said second channel signal.

3. A digital sound field reproducing device, comprising:

an analog-digital converter for receiving and converting 2-channel analog stereo signals into 2-channel digital stereo signals;

a first digital signal processor for receiving and converting said 2-channel digital stereo signals into 4-channel sound field signals;

an auxiliary memory for expanding a memory region of said first digital signal processor under the control of said first digital signal processor;

a second digital signal processor for receiving and composing said 4-channel sound field signals to generate 2-channel sound field signals, said 4-channel sound field signals include a first front left sound field signal, a first front right sound field signal, a first rear left sound field signal and a first rear right sound field signal, and said second digital signal processor comprising:

a first arithmetic device which adds said first rear left sound field signal to said first rear right sound field signal to generate a second rear right sound field signal, and subtracts said first rear left sound field signal from said first rear right sound field signal to generate a second rear left sound field signal;

a filter device which filters said second rear left sound field signal and said second rear right sound field signal into a third rear left sound field signal and a third rear right sound field signal, respectively, said third rear left sound field signal and said third rear right sound field signal having transfer characteristics;

a second arithmetic device which adds said third rear left sound field signal to said third rear right sound field signal to generate a fourth rear left sound field signal, and subtracts said third rear left sound field signal from said third rear right sound field signal to generate a fourth rear right sound field signal; and a third arithmetic device which adds a level-controlled said first front left sound field signal to said fourth rear left sound field signal to generate a first of said 2-channel sound field signals, and adds a level-controlled said first front right sound field signal to said fourth rear right sound field signal to generate a second of said 2-channel sound field signals;

a microcomputer for controlling sound field reproduction processes of said first digital signal processor and said second digital signal processor, according to a program stored in said microcomputer;

a keyboard with a plurality of function keys, for generating a key signal for identifying a speaker mode or a headphone mode to said microcomputer;

a digital-analog converter for converting said 2-channel sound field signals generated from said second digital signal processor into converted analog signals; and a switching means for selectively providing said coverted analog signals generated from said digital-analog converter to a headphone or to speakers under the control of said microcomputer.

4. The digital sound reproducing device as defined in claim 3, further comprising a display means for displaying a plurality of operation states including a speaker mode or a headphone under control of said microcomputer.

5. The digital sound reproducing device as defined in claim 3, wherein said second digital processor has associated first and second modes of operation, and wherein one of said modes of operation is selected and controlled by said microcomputer on operation of said switching means, and wherein said first mode of operation is associated with the providing of said analog signals to said headphone.

6. A digital sound field reproducing device, comprising:

an analog-digital converter for receiving and converting 2-channel analog stereo signals into 2-channel digital stereo signals;

a first digital signal processor for receiving and converting said 2-channel digital stereo signals into 4-channel sound field signals;

an auxiliary memory for expanding a memory region of said first digital signal processor under the control of said first digital signal processor;

a second digital signal processor for receiving and composing said 4-channel sound field signals to generate 2-channel sound field signals, said 4-channel sound field signals including a first front left sound field signal, a first front right sound field signal, a first rear left sound field signal and a first rear right sound field signal, and said second digital signal processor comprising:

a first arithmetic device which adds said first front left sound field signal to said first front right sound field signal to generate a second front right sound field signal, subtracts said first front right sound field signal from said first front left sound field signal to generate a second front left sound field signal, adds said first rear left sound field signal to said first rear right sound field signal to generate a second rear right sound field signal, and subtracts said first rear right sound field signal from said first rear left sound field signal to generate a second rear left sound field signal;

a filter device which filters said second front left sound field signal, said second front right sound field signal, said second rear left sound field signal, and said second rear right sound field signal into a third front left sound field signal, a third front right sound field signal, a third rear left sound field signal and a third rear right sound field signal, respectively, said third front left sound field signal, said third front right sound field signal, said third rear left sound field signal and said third rear right signal having transfer characteristics;

a second arithmetic device which adds said third front left sound field signal to said third front right sound field signal to generate a fourth front left sound field signal, subtracts said third front left sound field signal from said third front right sound field signal to generate a fourth front right sound field signal, adds said third rear left sound field signal to said third rear right sound field signal to generate a fourth rear left sound field signal, and subtracts said third rear left sound field signal from said third rear right sound field signal to generate a fourth rear right sound field signal; and a third arithmetic device which adds said fourth front left sound field signal to said fourth rear left sound field signal to generate a first of said 2-channel sound field signals, and adds said fourth front right sound field signal to said fourth rear right sound field signal to generate a second of said 2-channel sound field signals;

a microcomputer for controlling sound field reproduction processes of said first digital signal processor and said second digital signal processor, according to a program stored in said microcomputer;

a keyboard with a plurality of function keys, for generating a key signal for identifying a speaker mode or a headphone mode to said microcomputer;

a digital-analog converter for converting said 2-channel sound field signals generated from said second digital signal processor into converted analog signals; and a switching means for selectively providing said converted analog signals generated from said digital-analog converter to a headphone or to speakers under the control of said microcomputer.

* * * * *